US006053401A

United States Patent [19]

Andrews, Sr.

[11] Patent Number: 6,053,401

[45] Date of Patent: Apr. 25, 2000

[54] BEVERAGE CONTAINER

[75] Inventor: Jared P. Andrews, Sr., Grand Terrace, Calif.

[73] Assignee: J & M Coffee Container Company, Inc., Grand Terrace, Calif.

[21] Appl. No.: 09/105,815

[22] Filed: Jun. 26, 1998

[51] Int. Cl.[7] ..... B65D 5/4805; B65D 5/63; B65D 5/74

[52] U.S. Cl. ..... 229/117.3; 220/495.03; 220/504; 220/506; 220/553; 222/129; 229/117.15; 229/117.35; 229/120.03; 229/120.35; 229/122; 229/125.15

[58] Field of Search ..... 229/117.3, 117.35, 229/120.03, 120.32, 120.35, 122, 125.15, 117.14, 117.15, 117; 220/495.03, 503, 504, 505, 506, 553, 554, 555, FOR 120, FOR 122, FOR 174, FOR 177; 222/129

[56] References Cited

U.S. PATENT DOCUMENTS

| | | | |
|---|---|---|---|
| 181,014 | 8/1876 | Scott . | |
| 1,509,735 | 9/1924 | Laubersheimer | 229/117 |
| 1,631,932 | 6/1927 | Griffin | 222/129 |
| 2,135,410 | 11/1938 | Ottoson | 222/129 |
| 2,574,931 | 11/1951 | Nason . | |
| 2,618,409 | 11/1952 | Eisenberger et al. . | |
| 2,714,982 | 8/1955 | Strauss | 229/117.15 |
| 2,954,901 | 10/1960 | Winstead . | |
| 3,090,526 | 5/1963 | Hamilton et al. . | |
| 3,143,249 | 8/1964 | Merrill et al. . | |
| 3,160,326 | 12/1964 | Sturdevant et al. . | |
| 3,163,544 | 12/1964 | Valyi . | |
| 3,169,690 | 2/1965 | Scholle . | |
| 3,227,322 | 1/1966 | Crain . | |
| 3,233,817 | 2/1966 | Casady . | |
| 3,363,807 | 1/1968 | Powell . | |
| 3,584,768 | 6/1971 | Ascough | 229/120.35 |
| 3,927,824 | 12/1975 | Razziano | 229/117.14 |
| 3,931,916 | 1/1976 | Blue et al. . | |
| 3,954,220 | 5/1976 | Foster | 229/120.03 |
| 4,277,000 | 7/1981 | Jaarsma | 220/505 |
| 4,308,995 | 1/1982 | Hanes | 229/117.15 |
| 4,375,864 | 3/1983 | Savage . | |
| 4,653,671 | 3/1987 | Duffy et al. . | |
| 4,781,314 | 11/1988 | Schoonover et al. . | |
| 4,815,631 | 3/1989 | Eeg et al. . | |
| 5,048,691 | 9/1991 | Heuberger et al. . | |
| 5,125,566 | 6/1992 | Deiger . | |
| 5,147,071 | 9/1992 | Rutter et al. . | |
| 5,163,485 | 11/1992 | Hermann . | |
| 5,169,019 | 12/1992 | Budenbender . | |
| 5,186,359 | 2/1993 | Brown et al. | 222/129 |
| 5,392,958 | 2/1995 | Kurtzahn et al. . | |
| 5,715,992 | 2/1998 | Andrews, Sr. et al. | 229/125.15 |

FOREIGN PATENT DOCUMENTS

| | | |
|---|---|---|
| 0273 102 A1 | 7/1987 | European Pat. Off. . |
| 36122/75 | 10/1978 | United Kingdom . |

*Primary Examiner*—Gary E. Elkins
*Attorney, Agent, or Firm*—Knobbe, Martens, Olson & Bear, LLP

[57] ABSTRACT

A container is disclosed, including an outer shell with an integral handle and two flexible bags within the outer shell. The outer shell has a top, a bottom and sidewalls. The outer shell also defines two openings on opposing walls. Each of the bags within the outer shell defines an aperture sealed to and surrounded by a mouth, which defines a fluid passageway from the interior of the corresponding mouth to the outside of the container. The mouth is sized and shaped such that fluid can be poured through the mouth from a source having an outlet spaced above the mouth. The handle extends outwardly from the top of the outer shell and has sufficient strength to provide essentially all support for the container when the bags are filled with liquid in either of two positions: in the first position, one of the openings is facing upwards; in the second position, each of the openings is facing sideward. Desirably, the mouth and opening are sized and shaped such that, when the opening is facing upwards, the human eye can detect when a level of fluid in the container is approaching the mouth.

28 Claims, 9 Drawing Sheets

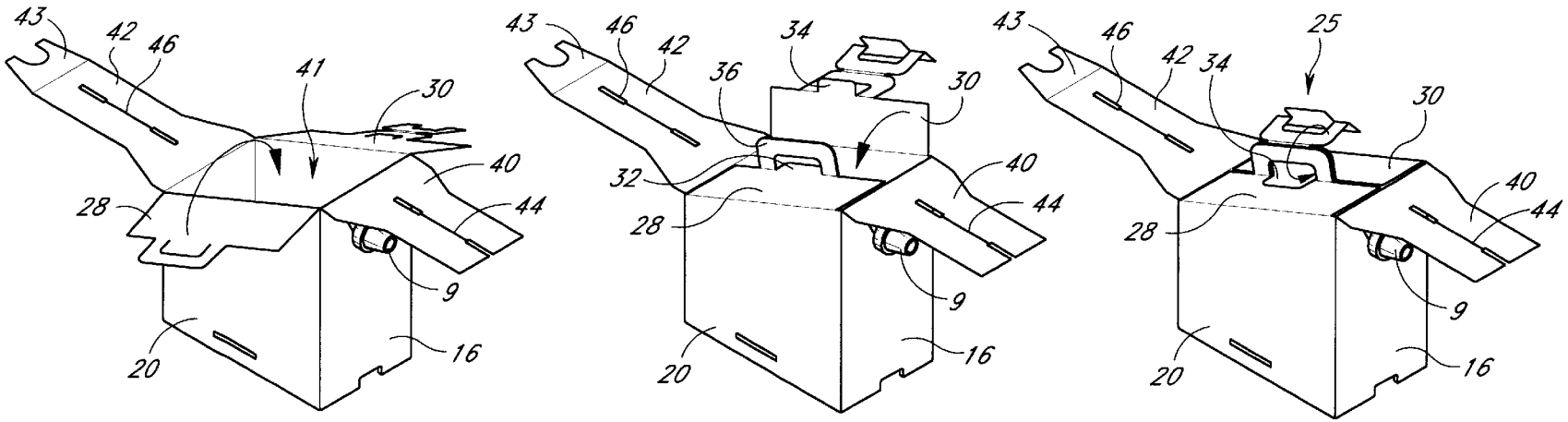
Fig. 4a
(PRIOR ART)
Fig. 4b
(PRIOR ART)
Fig. 4c
(PRIOR ART)
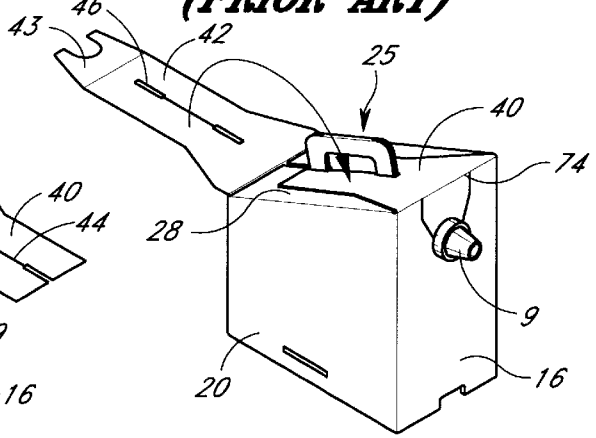
Fig. 4d
(PRIOR ART)
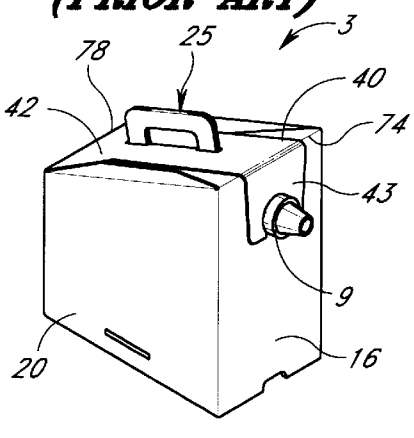
Fig. 4e
(PRIOR ART)
Fig. 4f
(PRIOR ART)

BEVERAGE CONTAINER

FIELD OF THE INVENTION

This invention relates to an improved beverage container. More specifically, this invention is directed to an improved container for storing and transporting several cups of fluid, such as coffee.

BACKGROUND AND SUMMARY OF THE INVENTION

Gourmet coffee shops typically sell individual cups of coffee for consumption on or off the premises. Typically, these shops are very small and utilize high-quality coffee beans and coffee-making equipment to provide consumers with a higher quality cup of coffee than would be available in other establishments. In this regard, many gourmet coffee shops have developed internal procedures particularly adapted to ensure a uniformly high-quality cup of coffee. Particularly at peak periods, these shops must dispense coffee to a relatively large group of consumers in a short amount of time. Typically, the worker holds the coffee cup below the spout and utilizes the other hand to actuate the spout until the worker sees that the coffee cup is nearly full.

Consumers accustomed to the high-quality of coffee available from such gourmet coffee shops have come to desire this high level of quality at other locations, such as offices or meeting places. Gourmet coffee shops have met this need by providing thermos canisters which are loaned out and then returned by the consumer. These canisters are often elongate, cylindrical thermoses having a pump button in the top, which dispenses coffee from a nozzle. Unfortunately, the inconvenience of returning the canister and the typical requirement that a deposit be left deters consumers from purchasing larger quantities of coffee. These canisters also have several drawbacks for the coffee shop. Specifically, they are relatively large and difficult to store, are breakable and require careful cleaning after each use.

Moreover, the coffee buyer is often serving the diverse needs of multiple consumers. For example, several members of a party may prefer decaffeinated coffee, while others prefer regular coffee. Some coffee drinkers may prefer dark roast coffee while others prefer milder blends. Where the buyer is providing multiple types of coffee or other liquid refreshments, the buyer must transport several canisters, which must each be returned and cleaned.

There is accordingly a need for a liquid container particularly adapted to store and insulate multiple cups of one or more fluids. Such a container should ideally be inexpensive enough to market as a disposable container, storable in compact form, and insulated for safe handling of hot fluids such as coffee.

In accordance with one aspect of the present invention, a liquid container is provided with an outer shell having a top, a bottom and sidewalls extending between the top and bottom. The shell has a first opening in one of the sidewalls and a second opening in another of the sidewalls. The container further includes two flexible bags housed within the shell, each of which define an aperture. A mouth is secured to each flexible bag, surrounding the corresponding aperture and defining a fluid passageway. Each mouth, in turn, is configured to be secured within one of the first and second openings in the outer shell. Additionally, a handle extends outwardly from the outer shell.

In accordance with another aspect of the present invention, a foldable liquid container is disclosed. The container includes an outer shell, which comprises two pairs of sidewalls, each pair aligned generally in parallel. One of the pairs of sidewalls includes a first opening in one sidewall and a second opening in the other, parallel sidewall. A flexible bag within the outer shell defines an aperture, with a mouth secured to the bag surrounding the aperture. The mouth thus defines a fluid passageway. A plurality of upper end flaps and lower end flaps are secured to the first pair of sidewalls and the second pair of sidewalls.

In accordance with still another aspect of the present invention, a liquid container is provided with an outer shell defining a first opening and a second opening. A first flexible bag is attached to and housed within the outer shell, and includes a tubular member which extends through the first opening. A second flexible bag is also attached to and housed within the outer shell, and includes a second tubular member which extends through the second opening. A stiff divider is provided within the outer shell, separating the first bag from the second bag.

In accordance with yet another aspect of the present invention, a collapsible container is provided for storing and dispensing two separate materials. The container comprises a front wall and an opposing back wall, where the front wall defines a first opening and the back wall defines a second opening. A pair of opposing side walls extend between the front wall and the back wall. A plurality of top flaps extend from the front, back and sidewalls, and fold to form a container top. Similarly, a plurality of bottom flaps extend from the front, back and side walls, and fold to form a container bottom. A divider extends from the front wall below the first opening to the back wall above the second opening, thereby defining a first compartment and a second compartment within an interior defined by the front, back and side walls.

BRIEF DESCRIPTION OF THE DRAWINGS

These and other aspects, and their attendant advantages, will be apparent to the skilled artisan from the appended drawings, which are intended to illustrate and not to limit the invention, and wherein:

FIGS. 4*a*–4*f* are perspective views illustrating the formation of the top of the beverage container of FIG. 1;

DETAILED DESCRIPTION OF THE PREFERRED EMBODIMENTS

Figure 1:
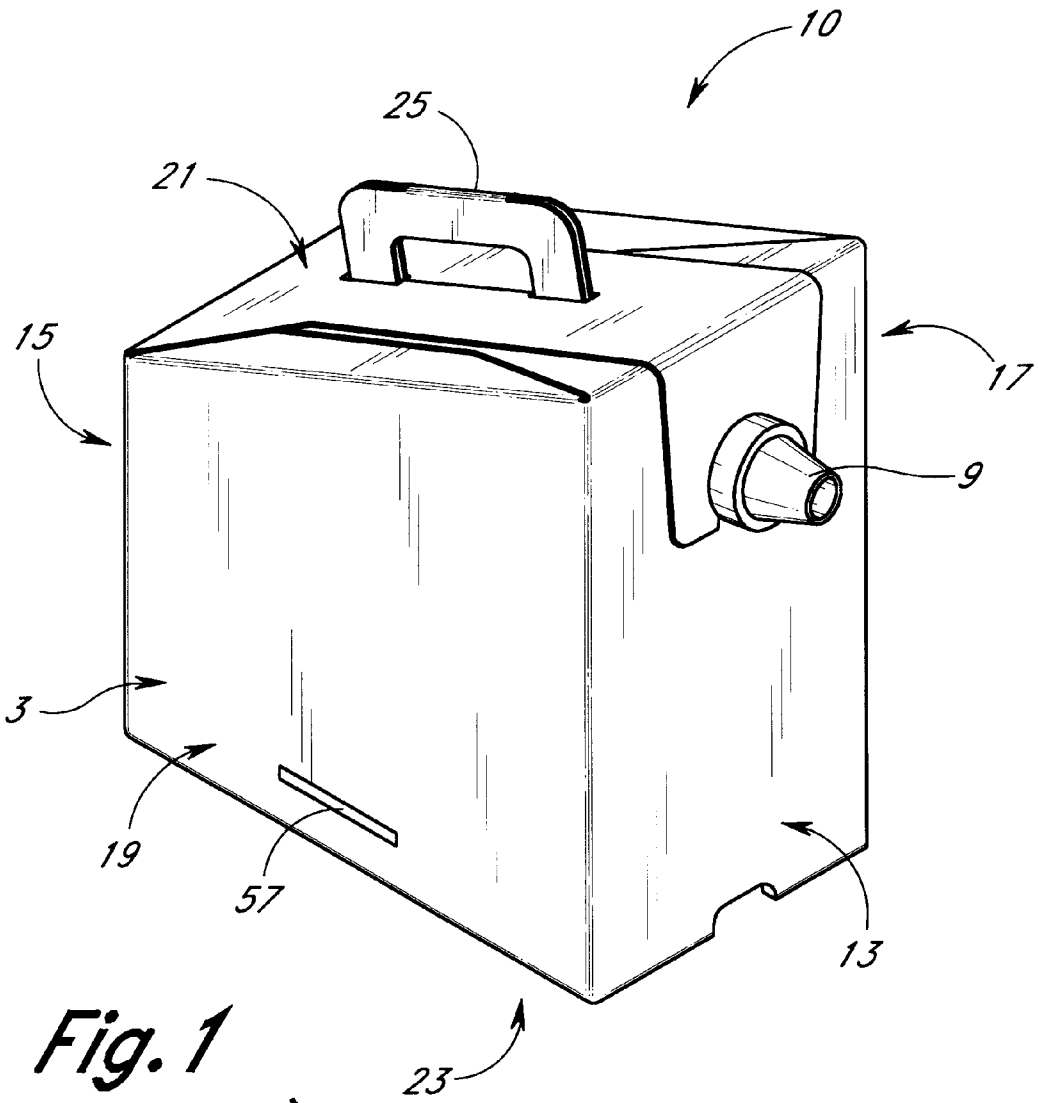
Fig. 1 (PRIOR ART)
FIG. 1 is a perspective view of a container constructed in accordance with the prior art.

FIGS. 1–7 illustrate a beverage container 10 in its assembled form, constructed in accordance with the prior art. This container is illustrated and described in U.S. Pat. No. 5,714,992, which issued on Feb. 10, 1998. The container 10 includes an outer container or shell 3, an inner bag 5 (best seen in FIGS. 5*a*–5*c*), a mouth 7 and a spout 9. The bag 5 is positioned within the outer shell 3 and communicates with the exterior of the container 10 by means of the mouth 7 and spout 9. The container 10 has a front 13, a back 15, a left side 17, a right side 19, a top 21 and a bottom 23. In addition, the outer shell 3 advantageously defines an integral handle 25.

Figure 2:
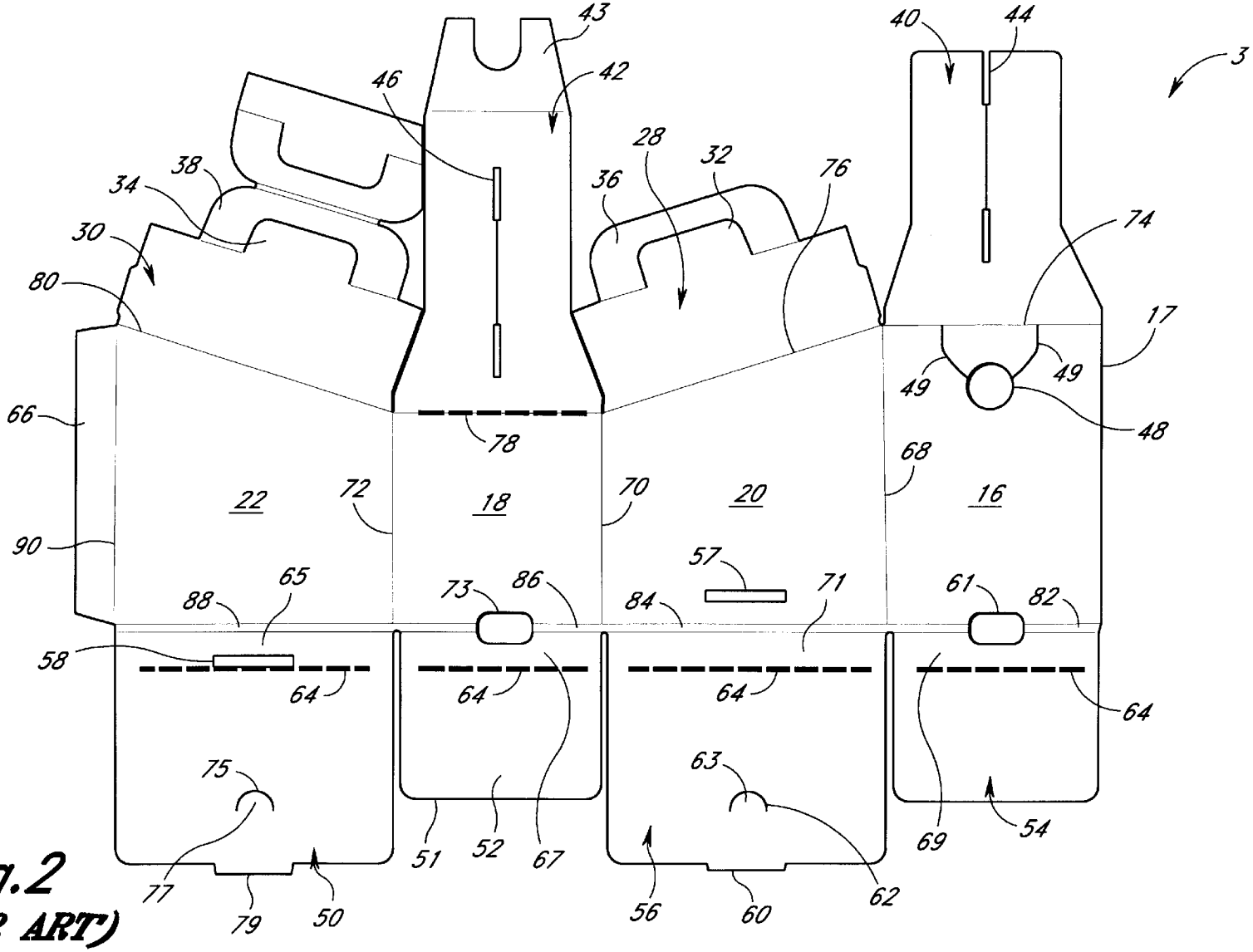
Fig. 2 (PRIOR ART)
FIG. 2 is a top plan view of a blank from which the outer shell of the container of FIG. 1 is manufactured.

As seen in FIG. 2, the outer shell 3 is advantageously configured to be constructed from a single one-piece cardboard blank. In the following description, the surfaces facing out of the page in FIG. 2 represent the outer surface of the container 10 shown in FIG. 1.

The shell 3 has a front wall panel 16, a back wall panel 18, a right side wall panel 20, a left side wall panel 22 and a side attachment tab 66. The front wall panel 16 defines a circular opening 48 and inwardly angled slits 49. The front wall panel 16 is hingedly attached along a right front fold line 68 to right side wall panel 20. Opposite the right front fold line 68, the right side panel 20 is hingedly attached to the back wall panel 18 along a right back fold line 70. The right wall panel 20 further defines a lower slot 57. Opposite the right back fold line 70, the back wall panel 18 is hingedly attached to the left wall panel 22 along a left back fold line 72. Opposite the left back fold line 72, the attachment tab 66 is attached to the left wall panel 22 along a left front fold line 90.

The blank further incorporates a series of top flaps and a series of bottom flaps. The top flaps include a top front flap 40, a top right handle flap 28, a top back flap 42 and a top left handle flap 30. The bottom flaps include a front bottom flap 54, right bottom flap 56, a back bottom flap 52 and a left bottom flap 50. The front wall panel 16 is hingedly secured along a top front fold line 74 to the top front flap 40, and also hingedly secured along a double bottom front fold line 82 to a bottom front flap 54. The double fold line facilitates the folding of the blank against itself along the double fold line, as is well-known in the art. The opening 48 is defined within the front wall panel 16 in close proximity to the top front fold line 74. The top front flap 40 defines an open-ended slot 44 extending to a distal edge of top front flap 40. The front wall panel 16 and bottom front flap 54 cooperate to define a front air aperture 61 along the bottom front fold line 82.

The right side panel 20 is hingedly coupled along a top right fold line 76 to the top right handle flap 28 and is also hingedly secured along a double bottom right fold line 84 to the bottom right flap 56. The top right handle flap 28 includes a right handle portion 36 and a right tab portion 32 separated by a slit. The bottom right flap 56 defines a small, generally semi-circular slit 62 which forms a finger flap 63. The bottom right flap 56 also defines a tab 60 extending from a distal edge of the bottom right flap 56.

The back side wall panel 18 is hingedly secured along a top back fold line 78 to the top back flap 42 and also hingedly secured along a double bottom back fold line 86 to the bottom back flap 52. The back wall panel 18 and bottom back flap 55 cooperate to define a back air aperture 73 along the bottom back fold line 86. The top back flap 42 includes an enclosed slot 46 and a generally U-shaped distal locking portion 43.

The left side wall panel 22 is hingedly secured along a top left fold line 80 to the top left handle flap 30 and hingedly secured along a double bottom left fold line 88 to the bottom left flap 50. The top left handle flap 30 includes a double left handle portion 38 and a pair of left tab portions 34 which are formed by cutouts to define an opening underneath the left handle portion 38, each similar to the single handle 36 and tab 32 of the top right handle flap 28.

Each of the bottom flaps 50, 52, 54 and 56 further defines a spacer fold line 64 approximately one-half inch from its respective wall panel 22, 18, 16 and 20. Directly above the fold line 64 on the bottom left flap 50 is a slot 58 sized for receiving the tab 60 of bottom right flap 56 when the container 11 is assembled, as will be understood from the discussion of FIGS. 5*a*–5*c*. A left spacer strip 65 of the bottom left flap 50 is defined between the parallel fold lines 64 and 88. The bottom left flap 50 includes a small, generally semi-circular slit 75 which forms a finger flap 77. The bottom left flap 50 also defines a tab 79 extending from a distal edge of the bottom right flap 50.

Preferably, the bag 5 comprises several layers, having an inside taste-neutral layer that imparts no flavor, a middle layer that insulates the heat of the liquid, and an outer layer for providing strength and flexibility. Such bags are available from Scholle Corporation, having a manufacturing facility in Rancho Dominguez, Calif. Desirably, the bag can be constructed from flat sheets, which are heat sealed and cut to form the desired shape.

Figure 7:
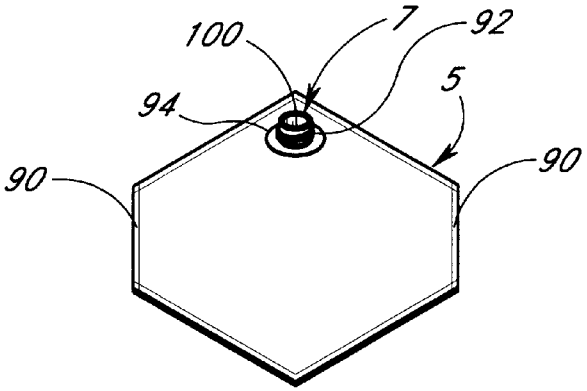
Fig. 7 (PRIOR ART)
FIG. 7 is a perspective view of the bag and mouth of the container of FIG. 1.

Referring to FIG. 7, the bag 5 is generally 13½ inches by 13½ inches, sealed along its entire perimeter and has vertically oriented dart seals 90 (as shown in FIG. 7) which form isosceles triangle shaped cutouts having equal sides of 4 inches along the perimeter of the bag 5 at the corners on either side of the mouth 7. The mouth 7 has a generally cylindrical body 92 with an annular outer rim 94 at one end which is bonded to the bag 5 by an appropriate adhesive or other means known in the art, and external threads 96 at the other end. The body 92 is desirably provided with a raised annular ring spaced slightly from tie outer rim 94 which forms an annular groove. The body 92 of the mouth 7 further defines a generally cylindrical internal channel 100.

A method of manufacturing, as distinct from "assembly" of the container by a retailer or consumer, is preferably performed prior to shipping the containers 10 to the coffee retailer. Advantageously, the bag 5 is connected to the outer shell 3 prior to connecting the side tab 66 of the left side panel 22 to the inside or outside surface of the front wall panel 16. It will be understood, however, that the bag 5 can be connected at a later point in manufacturing or during assembly by the retailer or consumer.

The mouth 7 is advantageously sized and shaped for the external threads 96 (FIG. 5) and raised annular ring to be slightly larger than the opening 48 (FIG. 2) in the front wall panel 16 of the outer shell 3. The slits 49 in the front wall panel 16 facilitate the insertion of the mouth 7 through the opening 48. Thus positioned, the mouth is secured within the outer shell 3 by the outer rim 94. The bag 5 may also be more securely retained in position within the outer shell 3 by means of adhesive between the rim 94 and the interior of the front wall panel 16 surrounding the opening 48. The bag 5 is desirably inserted into the outer shell 3 with its cutout corners and the corner opposite the mouth folded up and inward toward the center of the bag.

The tab 66 of the left side wall panel 22 is fastened to the front side wall panel 16 along an edge 17 of the front side wall 16 opposite of the right front fold line 68. The fastening may be accomplished by double sided adhesive strips, glue or other fastening means known to those of skill in the art.

Figure 6:
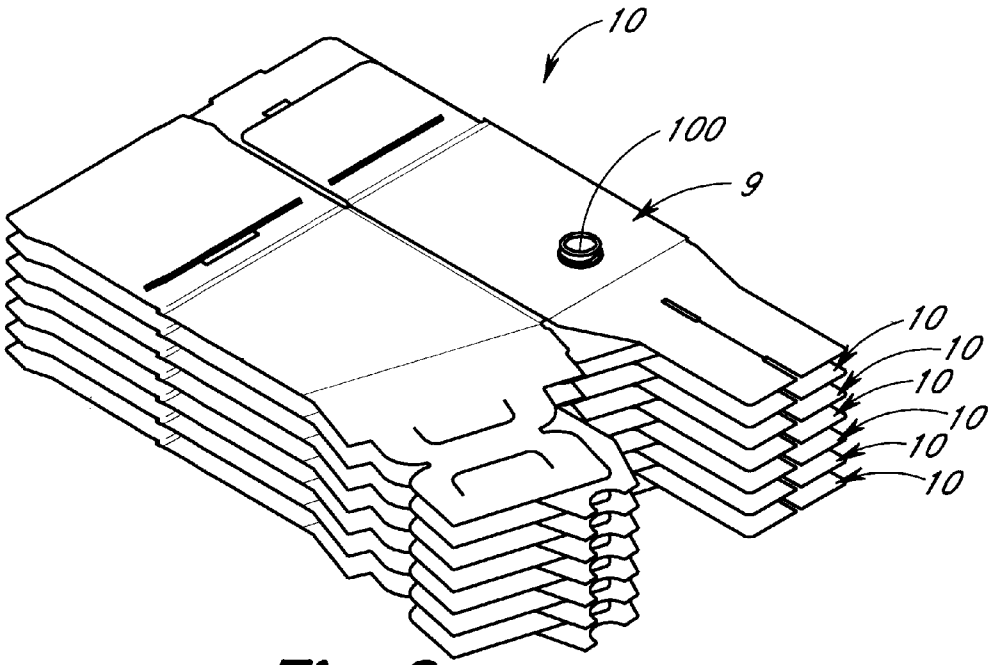
Fig. 6 (PRIOR ART)
FIG. 6 is a perspective view of several collapsed and stacked beverage containers, each constructed in accordance with the prior art.

Upon fastening, the outer shell 3 may then be laid and stored flattened with two adjacent side wall panels, panels 16 and 20 for example, facing upwards, and the other two side wall panels, panels 18 and 22, facing downwards. The outer shell is thus reads for quick assembly and may be stored efficiently in stacks as illustrated in FIG. 6.

Referring to FIGS. 4 and 5, the spout 9 of the container will now be described. The spout is desirably conical in shape and is internally threaded to mate with the external threads 96 of the mouth 7, and preferably includes a closable valve to prevent spillage during transportation. For convenience, the mouth may include a tear-off portion for sealing the container, until the destination is reached. Advantageously, the spout 9 is threaded onto the mouth after assembling and filling the container. Alternatively, any suitable closure mechanism, which is openable to allow pouring and closable to enable sealing the mouth 7, can be used, as will be understood by the skilled artisan. For example, a simple cap can threadably engage with the mouth for sealing, and can be threadably removed for pouring directly through the channel 100 and out of the mouth 7.

The assembly of the container 10 will now be described. As noted above, the surfaces of the outer shell 3 facing out of the page in FIG. 2 represent the outer surface of the container 10 illustrated in the remainder of the drawings.

Figure 3B:
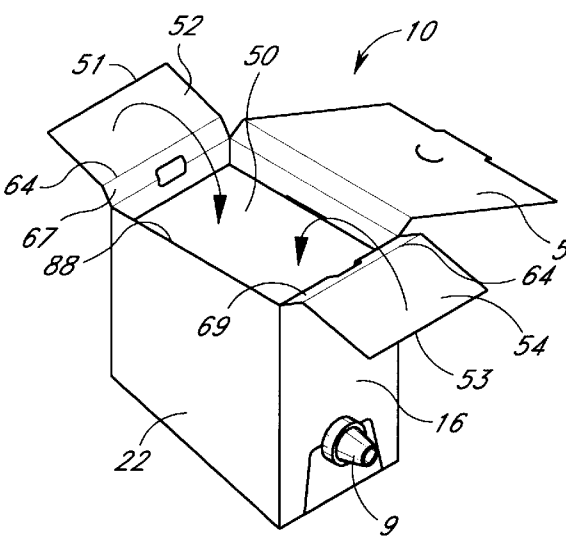
Fig. 3b (PRIOR ART)
FIGS. 3*a*–3*d* are perspective views illustrating the formation of the bottom of the beverage container of FIG. 1.
Figure 3A:
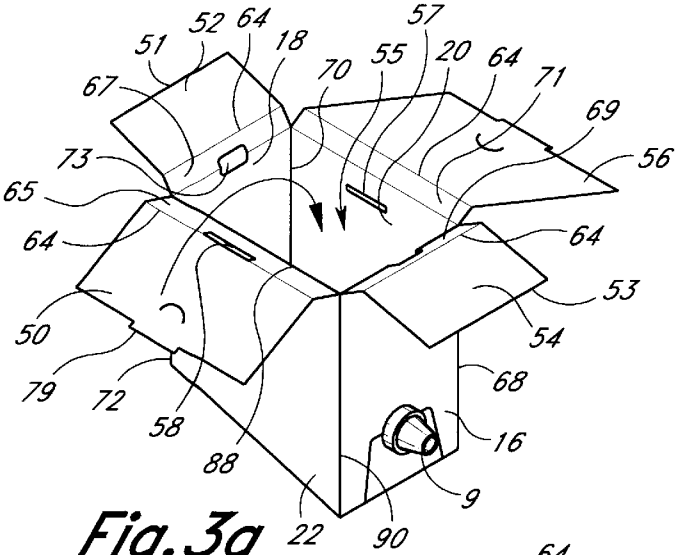
Fig. 3a (PRIOR ART)

FIGS. 3*a–d* illustrate the assembly of the bottom of the outer shell 3. FIG. 3*a* shows the container 10 turned over so that the bottom flaps 50, 52, 54, and 56 are facing upwards and the wall panels 16, 18, 20, and 22 are folded to form a substantially rectangular opening 55. In this position, the front wall panel 16 has been attached to the tab 66, which is folded along left front fold line 90 so that the front wall panel 16 is perpendicular to the left side wall panel 22. The front wall panel 16 is also oriented perpendicularly with respect to right side wall panel 20 along right front fold line 68, so that left side wall panel 22 and right side wall panel 20 are parallel to each other. The back wall panel 18 is folded along the left back fold line 72 to be perpendicular to the left side wall panel 22 and is also folded along the right back fold line 70 to be perpendicular to the right side wall panel 20. The back wall panel 18 is thus parallel to the front wall panel 16.

FIG. 3*a* indicates that the bottom left flap 50, which is secured to the left side wall panel 22 along bottom left fold line 88, is the first flap that is folded over. The bottom left flap 50 is folded along the bottom front fold line 88 into the opening 55. When the bottom left flap 50 is turned over, the left spacer strip 65 is folded down against the interior of left side wall panel 22, the tab 79 extends through slot 57 in the right side panel 20 and the distal edge of the bottom left flap 50 contacts the interior of right side wall panel 20, as shown in FIG. 3*b*. The bottom left flap 50, with the exception of the spacer strip 65, is thus oriented perpendicularly to the wall panels 16, 18, 20, and 22, and is recessed below the bottom left fold line 88.

Figure 3C:
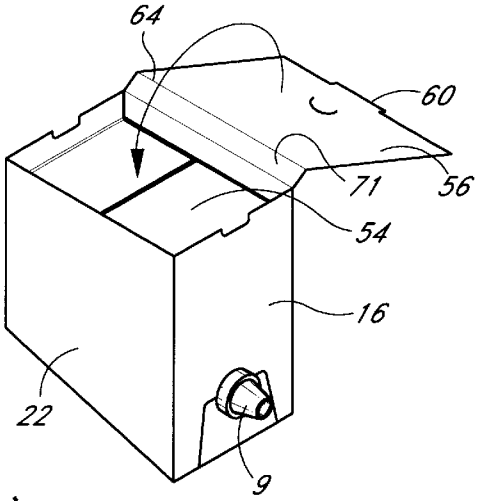
Fig. 3c (PRIOR ART)

FIGS. 3*b* and 3*c* indicate that the bottom back flap 52 and bottom front flap 54, which are secured to the back wall panel 18 and the front wall panel 16, respectively, are then folded over on top of the bottom left flap 50 about their respective bottom fold lines 86 and 82. As with the bottom left flap 50, the back spacer strip 67 of the bottom back flap 52 and the front spacer strip 69 of the bottom front flap 54 are folded down along the fold line 64 against the interior of the back wall panel 18 and the interior of the front wall panel 16, respectively. When the bottom flaps 52 and 54 are folded over onto bottom left flap 50, the edge 51 of the bottom back flap 52 meets with the edge 53 of the bottom front flap 54 to create a second layer of cardboard on top of the first layer, the bottom left flap 50.

Figure 3D:
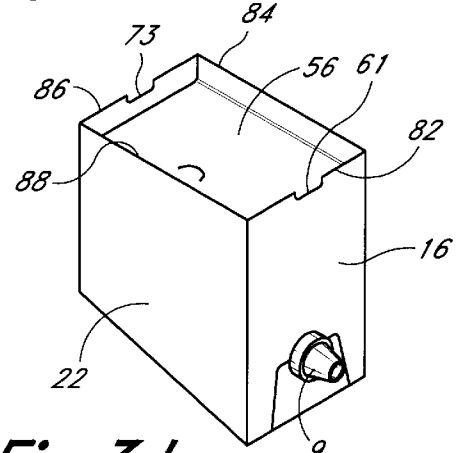
Fig. 3d (PRIOR ART)

FIGS. 3*c* and 3*d* illustrate that the bottom right flap 56 is the last bottom flap to be folded over to create the bottom of the outer shell 3. When the bottom right flap 56 is folded over, the right spacer strip 71 of the bottom right flap 56 is folded down along the fold line 64 against the interior of the right side wall 20. The bottom flap 56 is then folded over onto the bottom flaps 52 and 54, thereby creating a third recessed cardboard layer. The tab 60 of the bottom right flap 56 is inserted onto the slot 58 (FIG. 2) of the bottom left flap 50 to secure the bottom flaps 50, 52, 54, and 56 in place.

Thus assembled, the front air aperture 61 and the back air aperture 73 form air vents to permit the circulation of air in the space defined between the recessed bottom right flap 56 and a flat surface (e.g., counter) on which the container 10 is placed. To remove the bottom flaps from the secured position shown in FIG. 3*d,* a user may pull the bottom flap out of its secured position by using the finger flap 63 of the bottom flap 60 or the opening formed by pushing the finger flap 63 inward.

FIGS. 4*a–4f* illustrate the formation of the top and handle 25 of the outer shell 3. FIGS. 4*a* and 4*b* indicate that the top right handle flap 28, which is secured to right side wall panel 20 along top right fold line 76, is folded over into opening 41 in the top so that the top right handle flap 28 is in alignment with the top right fold line 76. FIG. 4*b* illustrates that right handle portion 36 is then folded upward from the top right handle flap 28 so that the right handle portion 36 is perpendicular to the remainder of the top right handle flap 28.

FIG. 4*c* shows that the top left handle flap 30 is then folded down and the left handle portion 38, which is also folded upright like the right handle portion 36, cooperates with right handle portion 36. The first or proximal tab 34, which is cutout from underneath the left handle portion 38, is placed through the opening underneath the right handle portion 36 and over the right tab 32. As shown in FIG. 4*d,* the second or distal part of the double left handle portion 38 is then folded over the right handle portion 36 and the second or distal tab 34 of the left handle portion 38 is slid under the proximal tab 34 of the left handle portion to form the handle 25 of the outer shell 3.

FIG. 4*e* shows the top front flap 40 folded over along top front fold line 74 onto the top right handle flap 28 and the top left handle flap 30. The handle 25 is inserted through the open-ended slot 44, thereby allowing the top front flap 40 to rest flat against the right and left handle flaps 28 and 30. As shown in FIG. 4*f,* the top back flap 42 is folded over along top back fold line 78 onto the top front flap 40 and the top right and left handle flaps 28 and 30. The handle 25 is inserted through the slot 44 of the top back flap 42, allowing the top back flap 42 to rest flat against the top front flap 40 and the top right and left handle flaps 28 and 30. The distal locking portion 43 of the top back flap 42 is inserted into the groove formed by the body 92 of the mouth so that the locking portion 43 prevents the mouth 7 from being pulled back into the outer shell 3 by the weight of the liquid when filled. The top front flap 40 and the top back flap 42 lock the handle flaps 28 and 30 in place. Thus assembled, the handle 25 defines a first end proximate the front wall panel 16, a second end spaced further from the front wall panel than the first end, and an opening between first end and the second end sized and shaped to receive the fingers of a hand.

Desirably, the front 13 of the outer shell 3 has a vertical height of roughly 8½ inches and a width of roughly 6⅛ inches. The bottom 23 has a width of roughly 6⅛ inches and a length of roughly 8½ inches. The back 15 of the outer shell has a height of roughly 6 inches and a width of roughly 6¼ inches. The skilled artisan will understand, however, that these and other dimensions of the container 10 can be scaled upward or downward, or varied relative to one another.

Figures 5A, 5B, 5C:
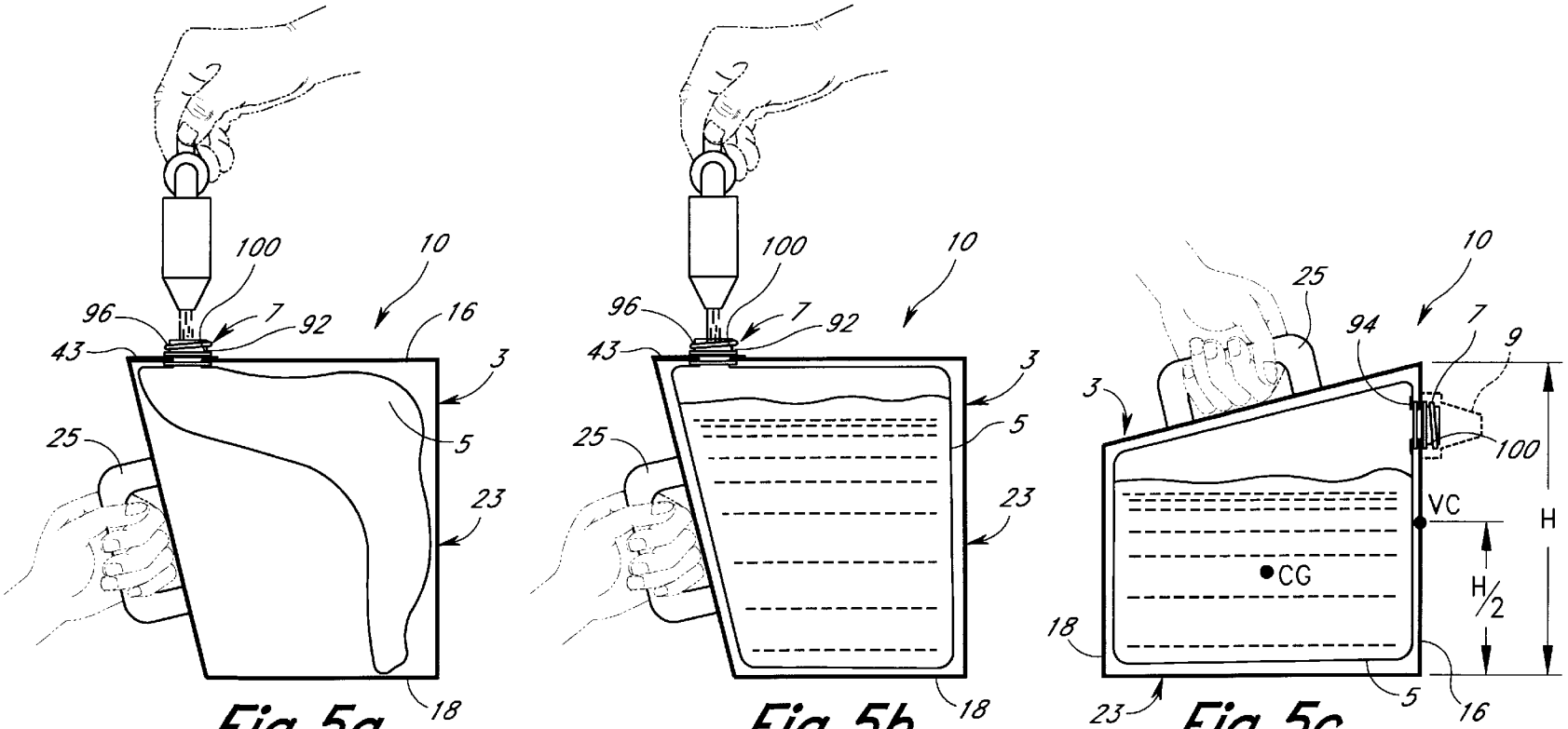
Fig. 5c (PRIOR ART)
Fig. 5b (PRIOR ART)
Fig. 5a (PRIOR ART)
FIGS. 5*a*–5*b* are cross-sectional side views illustrating the filling of the bag of the beverage container of FIG. 1.
FIG. 5*c* is a cross-sectional side view illustrating the container in a position rotated 90° with respect to that of FIG. 5*b;*

FIGS. 5*a* and 5*b* illustrate the filling of the container 10. FIG. 5*a* is a schematic view illustrating the compressed, flexible bag 5 located within the outer shell 3 and the container in the "fill" position—namely, held in one hand of the user with the container 10 resting on its back side wall panel 18 with the front side wall panel 16 facing upwards. The other hand of the user actuates the spigot from the pot. FIG. 5*b* illustrates coffee being poured into the bag 5 through the mouth 7 from a spigot spaced over the mouth 7, thereby forcing the bag to expand. To maximize the volume of liquid that the beverage container 10 may hold, the bag 5 is sized and shaped so that it may expand into the comers of the outer shell 3. Advantageously, the container has a capacity of at least 48 ounces of fluid, desirably, between 70 and 200 ounces of fluid and, most desirably, roughly 96 ounces of fluid.

Since the mouth 7 desirably defines a flow channel having a diameter of at least ¾ inches, desirably at least one inch and most desirably 1¼ inches, the user is able to visually determine when the level of fluid in the bag is proximate the bottom of the mouth 7 (FIG. 5*b*) and moves the spigot to cut off the flow of fluid into the container 10. The bag 5 is desirably sized such that when the level of fluid in the container is proximate the bottom of the mouth 7 when the container is positioned with its back wall panel 18 faced downward and in a horizontal orientation, when the container 10 is rotated to rest on its bottom 23 with the handle 25 facing up (FIG. 5*c*), the level of fluid in the bag 5 is below any opening formed by the spout 9 and, desirably, below the internal flow channel 100 of the mouth 7. This reduces the risk of spilling during transport and the risk of injury to the user from spillage of hot coffee when the spout is opened. Effectively, the bag 5 "sags" within the outer shell 3 when the container is rotated from its fill position to its "carry" position so that the level of fluid is below the level of the mouth. The volume of fluid in the container when the container is in its fill position and the level of fluid in the container is proximate the bottom of the mouth 7, is referred to as the "normal fill volume."

One advantage of the illustrated container 10 is that the flaps 40 and 42 minimize the load on the handle 25 by transferring a portion of the load from the weight of the container 10 and the contents from the handle 25 across the flaps 40 and 42. With the handle 25 secured in place, the container 10 may be easily transported and carried like a briefcase. The carrier thus avoids having to hold the outer shell 3 which may be hot from the coffee or other liquid inside by the wall panels.

Another advantage is that when the container is filled to its normal fill volume and positioned with its bottom facing downward and in a horizontal orientation, the center of gravity CG of the filled container is located at least one-half inch below the vertical center of the container VC (i.e., half-way between the top and bottom of the outer shell) and, preferably, at least one inch below the center of gravity of the container. This is important to reduce the risk that the container will tip over during transport. In addition, the cross-sectional area of the bottom of the outer shell 3 is desirably as large as any horizontal cross-section of the container to further reduce the risk that the container will tip over when transporting or manipulating the container.

Advantageously, the top of the outer shell 3 ramps upward from the back side wall panel 18 to the front side wall panel 16, which has the opening 48 for a spout. This preferred design facilitates dispensing fluids from the container when a user grips the handle 26 and rotates the container 10 forward to pour the fluid within the container out of the spout 9. Specifically, the amount the user needs to pivot their hand relative the arm to pour is reduced, because the fluid in the container is already tipped toward the spout when the handle is horizontal.

The outer shell 3 provides multiple layers of cardboard in bottom flaps 50, 52, 54, and 56, thereby spacing the hot fluid from the bottom 23 of the container 10 and providing insulation from the heat. All of this is possible in a low cost container 10 particularly adapted to be constructed of such low cost materials that it can be cost-effectively marketed as a "disposable" container.

The container 10 is also particularly adapted to be used to mix hot or cold flavored drinks, by means of storing a flavor concentrate, such as flavor crystals or syrup in the bag 5 of a flattened container until it is desired to add diluting liquid thereto. In this case, the channel 100 of the mouth 7 is desirably sealed by the spout 9 or other means, such as a removable aluminum cover. The flavor crystals or syrup could be added by the wholesale distributor of the box or the retailer.

The container 10 can be used to heat or cool liquids by placing a source of heat or a cold pack or ice in the outer shell 3 before closing either the top flaps or the bottom flaps of the outer shell. Alternatively, it is possible to insert ice through the mouth 7 into the bag 5, to chill fluid therein.

Figure 8B:
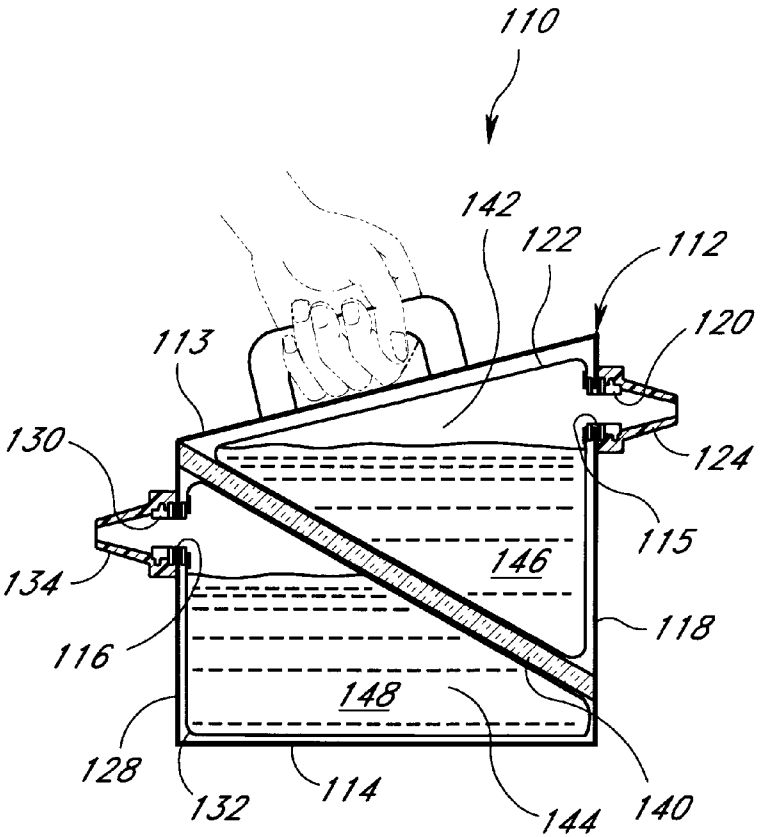
FIGS. 8*a*–8*d* are cross-sectional views of a beverage container constructed in accordance with a preferred embodiment of present invention, illustrating the container empty of fluid, filled with fluid, pouring fluid out of a first mouth, and pouring fluid out of a second mouth, respectively.
Figure 8A:
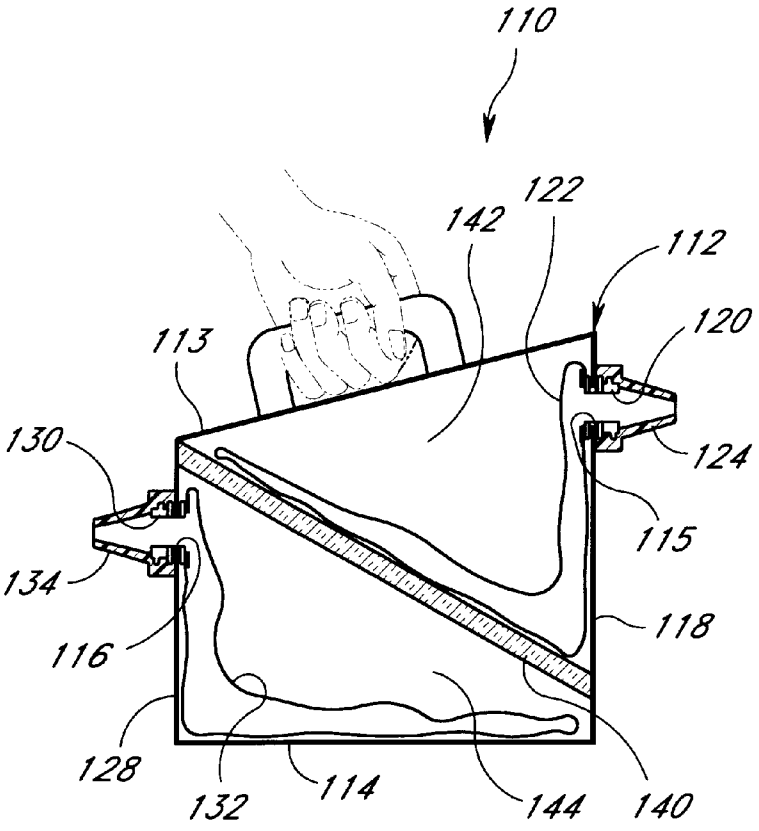

FIGS. 8*a*–8*d* illustrate a container 10 constructed in accordance with a preferred embodiment of the present invention. Referring initially to FIG. 8*a*, the container 110 includes an outer shell 112, which is desirably provided with a similar overall construction as the shell 3 of FIGS. 1–7. Accordingly, unless otherwise noted, the above description of the outer shell 3 of FIGS. 1–7 applies equally to the outer shell 112 of the preferred embodiment. In particular, the outer shell 112 is also advantageously constructed of low cost, disposable materials (such as cardboard) and is provided with a plurality of flaps which facilitate rapid and reversible assembly from a collapsed condition by a beverage retailer or consumer. A top 113 of the shell 112 is also angled or ramped relative to a bottom 114, facilitating pouring while fluid levels within the container remain below the spout when the container is held or placed with the bottom parallel to the ground.

Unlike the shell 3 of FIGS. 1–7, however, the outer shell 112 of the preferred embodiment includes two openings 115, 116 on opposite sides of the container 110. Furthermore, it will be understood in light of the disclosure herein, that certain of the advantages of the preferred embodiment are independent of the form of the outer shell.

In the illustrated embodiment, the first opening 115 is located at an upper end of a front wall panel 118. A first mouth 120 extends through the first opening 115, sealed to a first flexible bag 122 on the inside of the shell 112, and threadably attached to a first spout 124 on the outside of the shell 112. Each of the mouth 120, bag 122 and spout 124 can be as described with respect to the FIGS. 1–7, with the exception of the size of the bag 122, as will be understood in light of the following disclosure. While not shown, the opening 115 through which the mouth 120 extends can also be formed with inwardly angled slits to facilitate insertion and maintenance of the mouth 120 in the opening without tearing or stretching the panel 118 around the opening 115.

The illustrated second opening 116 is located at an upper end of a back wall panel 128. A second mouth 130 extends through the second opening 116, sealed to a second flexible bag 132 on the inside of the shell 112, and threadably attached to a second spout 134 on the outside of the shell 112. The second mouth 130, second bag 132 and second spout 134 can also be as described with respect to the FIGS. 1–7, with the exception of the size of the second bag 132.

The container 110 is also shown to include a divider 140 extending across the internal space defined by the assembled outer shell 112. Preferably, the divider 140 is a stiff member extending at an angle from the upper corner at the juncture of the back wall panel 128 and the top 113, downwardly to the front wall panel 118. Though not apparent from the views of FIG. 8, it will be understood that the divider 140 also extends from sidewall to sidewall, thus dividing the space within the outer shelf 112 into a first compartment 142, housing the first bag 122, and a second compartment 144, housing the second bag 132. In the illustrated embodiment, the divider 140 evenly divides the container such that each of the compartments 142, 144 has a capacity of approximately 48 fluid ounces. For the outer shell dimensions given with respect to FIGS. 1–7 above, the illustrated divider thus terminates at the front wall panel 118 approximately 1 inch above the bottom 114. It will be understood that the divider 140 can be integrally formed as one of the flaps on the outer shell 112, or can be separately provided as an optional insert.

In the illustrated embodiment, the divider 140 comprises a thermally insulating material such as corrugated cardboard or styrofoam. If the container 110 is to carry hot fluid in both compartments, or cold fluid in both compartments 142, 144, the insulating character of the divider 140 is unimportant. Indeed, as further described below, the divider need not be provided for such hot/hot or cold/cold uses, though it is preferred.

FIG. 8*a* illustrates the container 110 in an assembled state, including the divider 140 between the two bags 122, 132, with both bags 122, 132 collapsed and empty of fluid. Each of the bags 122, 132 can be filled by pouring fluid from a source spaced above the respective mouths 120, 130, as described with respect to FIG. 5. When filling each bag 122, 132, a side wall panel 118 or 128 faces upward. Risk of overfilling is minimized by the ability of the user to see the fluid level through the wide mouths 120, 130. Pouring can thus be stopped when fluid level reaches a point just below the respective mouths 120, 130, leaving a short column of air above the fluid in the each compartment 142, 144.

FIG. 8*b* illustrates the container 110 after each of the bags 122, 132 has been filled with a first fluid 146 and a second fluid 148, respectively. As illustrated, the fluid levels remain below the respective mouths 120, 130 of each compartment 142, 144, despite the large volume of fluid contained in the bags 122, 132.

In the first compartment 142, the weight of the first fluid 146 naturally causes the first bag 122 to settle into the lower reaches of the compartment 142. Due to the geometry of the container shell 112, the air column left within the first compartment 142 above the fluid 146 is higher at the mouth 120 in the upright orientation than it is in the fill position (compare FIG. 5*b* with FIG. 5*c*). The angled ceiling created by the top 113, presenting a triangular cross-section to the upper portion of the first compartment 142, contributes to this effect. The capacity of the first bag 122 can also be limited to avoid overfilling the bag 122. Accordingly, the first mouth 120 can remain clear of the fluid 146, thus minimizing the risk of spillage, without wasting a large volume within the first compartment 142.

Similarly, the divider 140 creates an angled ceiling for the second compartment 144. As with the first compartment 142, the second compartment 144 can be almost completely filled with the second fluid 148. Still, the small volume of air left above the fluid 148 is enough to leave the second mouth 130 clear of the fluid 148, thus minimizing the risk of spillage.

The use of separate bags 122, 132 with separate mouths 120, 130 enables storage and transportation of two different fluids. For example, the first fluid 146 could comprise regular coffee while the second fluid 148 comprises decaffeinated coffee. Similarly, the first fluid 146 could comprise a dark roast coffee, while the second fluid 148 comprises a flavored coffee, tea, or any of a number of other hot beverages. Alternatively, both fluids could comprise cold beverages. In any of these cases, as noted above, the divider 140 need not thermally insulate the first bag 122 from the second bag 132. In fact, if the divider 140 is provided as a separate and optional insert, the user can choose not to employ the divider 140 when storing and transporting two hot fluids or two cold fluids. Without the divider, the fluid levels in both flexible bags would exhibit the same tendency to having a low center of gravity as the fluid level in the single bag of FIGS. 1–7.

As noted, however, the divider 140 preferably comprises an insulating material. Accordingly, the first fluid 146 in the first compartment 142 can be thermally insulated from the second fluid 148 in the second compartment. The first bag 122 can house a hot fluid while the second bag 132 holds a cold fluid, or vice versa. If the container 110 is to house both hot and cold fluids, the hot fluid is preferably stored as the first fluid 146 in the first compartment 142, above the second fluid 148. For example, the first fluid 146 can comprise hot coffee while the second fluid 148 comprises cold orange juice. In an alternative arrangement, a first compartment can occupy the majority of the container, while a smaller compartment can be used to hold cream or milk for use with the coffee.

In accordance with the preferred container 110, the slanted divider 140 thus enables the hot fluid to be largely housed above the cold fluid, such that rising heat from the hot fluid does not heat the lower cold fluid and the hot fluid is kept further away from the furniture on which the container 10 rests. At the same time, the advantages with respect to minimizing risk of spillage obtain.

The first mouth 120, first spout 124 or other capping mechanism can be provided in a different color from the second mouth 130, second spout 134 or other capping mechanism, to help the user remember whit fluid has been stored in which compartment. For example, the first spout 124 can be brown, signifying regular coffee, while the second spout is colored orange, which can signify either decaffeinated coffee or orange juice. Spouts can also be colored blue and red, signifying cold and hot fluids, respectively. Alternatively, the outer shell 112 can be provided with insignia proximate the openings 115, 116 to remind the user which side should be used to store which fluid.

Figure 8D:
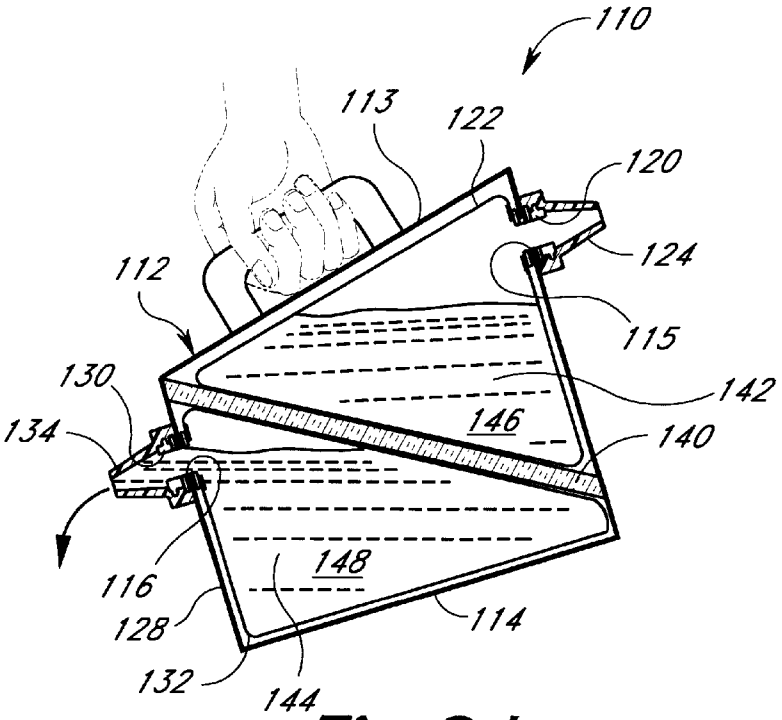
Figure 8C:
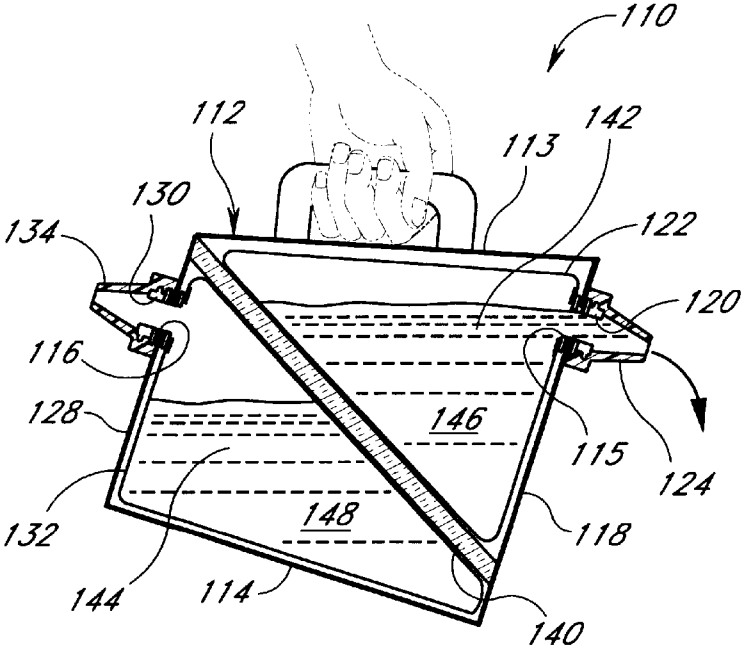

Referring to FIGS. 8*c* and 8*d,* the illustrates dual compartment container 110 can dispense fluids 146, 148 from either one of the compartments 142, 144 without spilling the fluid from the other compartment. FIG. 8*c*, for example, illustrates a user grasping a handle of the container 110 and rotating the container 110 clockwise (as viewed), so that the mouth 120 and spout 124 fall below the level of the first fluid 146. The first fluid 146 thus pours out through the first mouth 120 and first spout 124. At the same time, however, the second fluid 148 moves further away from the second mouth 130 and second spout 134. Accordingly, the second fluid 148 cannot spill while the first fluid 146 is being poured, even if the second spout 134 is open and the second mouth 130 is not otherwise capped or sealed.

FIG. 8*d* shows the user rotating the container 110 counterclockwise (as viewed), so that the second mouth 130 and second spout 134 fall below the level of the second fluid 148. At the same time, the first fluid 146 moves further away from the first mouth 120 and first spout 124. Thus, the first fluid 146 cannot spill while the second fluid 148 is being poured, even if the first spout 124 is not closed and the first mouth 120 is not otherwise capped or sealed.

The fact that the openings 115 and 116 are on opposite sides of the container 110 facilitates the ability to pour fluid out of one of the compartments 142, 144 without spilling fluid out of the other compartment. As will be understood by the skilled artisan, however, the geometry of the preferred container 110, including the sloping top 113 and the slanted divider 140, further facilitate this advantage.

Figure 9:
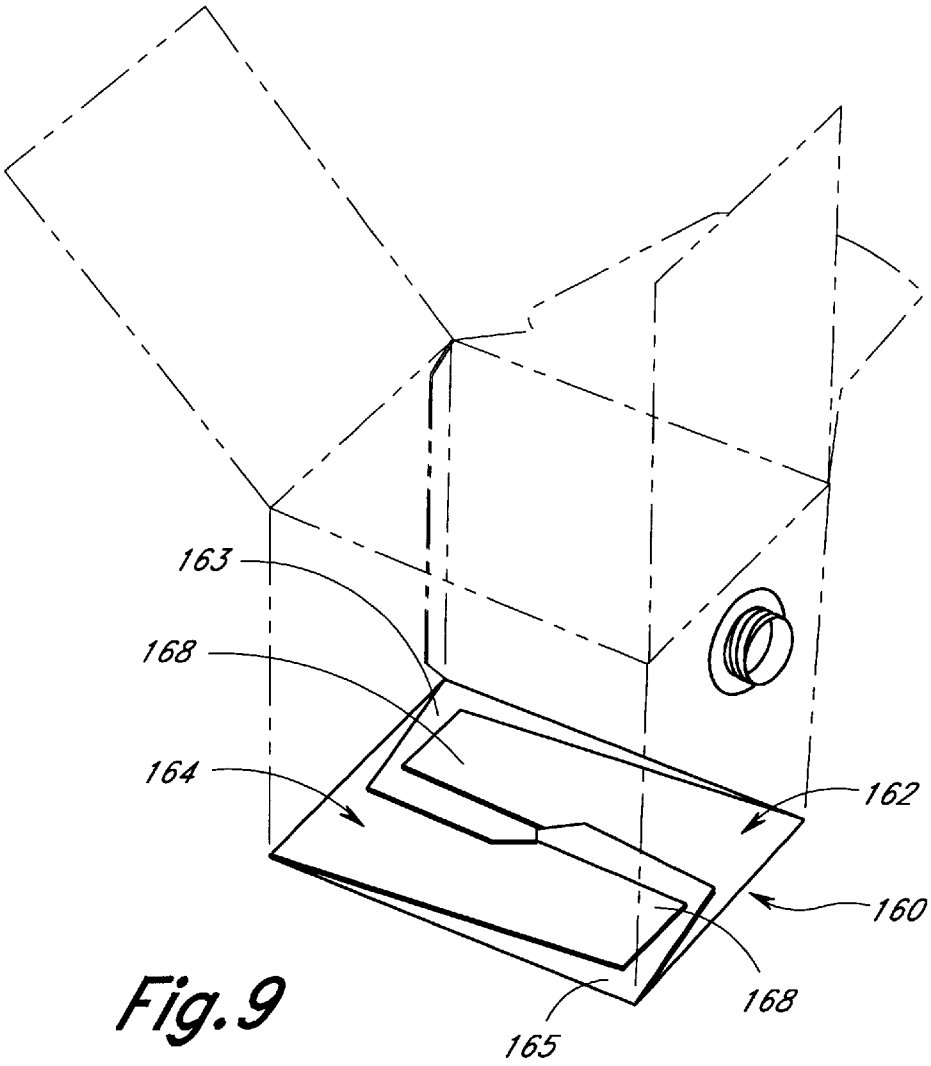
FIG. 9 is a perspective view of an automatically folding and unfolding container bottom, constructed in accordance with another embodiment.

Referring to FIG. 9, the preferred embodiment can include an automatically folding bottom 160 of a type known in the art of collapsible containers. As will be understood by the skilled artisan, the automatically folding bottom 160, or "autobottom," is formed by flaps 162–65 extending from each of the side, front and back walls of the outer shell.

In the illustrated example, two flaps 162, 164 on opposing sides include interlocking extensions 168 at one end. The other end of each of these opposing flaps 162, 164 is affixed to one of the other pair of opposing flaps 163, 165. For example, flap 162 is glued beneath the flap 165. Although adjacent flaps 162, 165 are thus affixed to one another, the container can still be folded because the flap 162 includes a perforation at which the flap 162 folds as the container is collapsed.

As the container is unfolded, the various flaps 162–165 automatically interleave to form the bottom 160 which will support the weight of fluid-filled bags within the container. Moreover, such a bottom is particularly advantageous for storing hot fluid, as the fluid stored within the bags 122, 132 is spaced and thus insulated from the bottom surface of the container (i.e., that surface which contacts furniture) by the thickness of the intervening flaps 162–165.

The containers in accordance with the present disclosure provide numerous advantages over conventional fluid containers. Like the conventional thermos, the containers are adapted to store, insulate and transport multiple cups of fluid. Desirably, the disclosed containers are adapted to be stored in a flattened state, thereby conserving large amounts of space in stores that sell coffee to go. At the same time, the illustrated containers are quickly and easily deployable. The containers can be filled with existing equipment utilizing dispensing equipment and procedures already used in most coffee shops. The containers are adapted to be easily carried and poured from, using the same integral handle. Advantageously, the structure of the container reduces the likelihood that the container will tip over during transport and incorporates safety features which reduce the risk of injury to the user or damage to furniture from hot coffee.

Because the containers are particularly adapted to be made of very inexpensive materials, they can economically be disposed of after use. A disposable container formed in accordance with the present disclosure can thus be provided at the store, rather than requiring the customer to provide container, and rather than having the store loan out more expensive containers which must be returned and cleaned.

Furthermore, the preferred containers can be employed for two hot and/or cold fluids, simultaneously or separately. The fluids are sufficiently insulated for their intended purpose within the container, maintaining the temperature of hot or cold fluids during transportation and storage while preserving the user from burns. The disclosed containers can be collapsed or folded, conserving storage space prior to use, and are inexpensive enough to be disposed of after use.

Those of skill in the art will recognize that there are numerous variations and modifications of this invention which are encompassed by its scope. Accordingly, the foregoing description should be considered illustrative of the invention and not deemed to limit its scope.

We claim:

1. A liquid container comprising:

an outer shell having a top, a bottom and sidewalls extending between the top and bottom, the outer shell having a first opening in one of the sidewalls and a second opening in another of the sidewalls;

a first flexible bag within the outer shell defining a first aperture;

a first mouth secured to the first flexible bag surrounding the first aperture and defining a first fluid passageway, the first mouth configured to be secured within the first opening of the outer shell;

a second flexible bag within the outer shell defining a second aperture;

a second mouth secured to the second flexible bag surrounding the second aperture and defining a second fluid passageway, the second mouth configured to be secured within the second opening of the outer shell; and a handle extending outwardly from the outer shell.

2. The container of claim 1, further comprising a divider separating the first flexible bag from the second flexible bag within the outer shell.

3. The container of claim 2, wherein the divider comprises a thermally insulating material.

4. The container of claim 2, wherein the divider extends from one sidewall to another sidewall at an angle with respect to the bottom.

5. The container of claim 4, wherein a hot fluid is housed within the first flexible bag above the divider and a cold fluid is housed within the second flexible bag below the divider.

6. The container of claim 4, wherein the top is sloped relative to the bottom.

7. The container of claim 6, wherein the handle extends from the top.

8. The container of claim 1, wherein each of the first and second mouths is sized and shaped such that when the corresponding opening is facing upwards a human eye can detect when a level of fluid in the container is approaching the mouth.

9. The container of claim 8, wherein each of the first and second mouths define an aperture having a span of at least one inch.

10. The container of claim 1, wherein the first mouth is sized and shaped such that a first fluid can be poured through the first fluid passageway from a source having an outlet spaced above the first mouth in a first fill position, and the second mouth is sized and shaped such that a second fluid can be poured through the second fluid passageway from a source having an outlet spaced above the second mouth in a second fill position.

11. The container of claim 10, further comprising a first spout removably coupled to the first mouth, the spout in fluid communication with the inside of the first bag for pouring the first fluid from the container.

12. The container of claim 1, wherein the bags and the outer shell are sized and shaped such that when the first and second bags are substantially full of liquid, the center of gravity of the container is located at least one-half inch below the center of the container.

13. The container of claim 1, wherein the outer shell is collapsible.

14. The container of claim 13, wherein the outer shell is formed of cardboard.

15. A foldable liquid container, comprising:

an outer shell comprising a first pair of side walls aligned generally in parallel to one another and a second pair of side walls aligned generally parallel to one another, the outer shell defining a first opening in the first pair of side walls and a second opening in the other of the first pair of the side walls;

a first flexible bag within the outer shell defining, a first aperture;

a first mouth secured to the first bag surrounding the first aperture and define a first fluid passageway;

a plurality of upper end flaps secured to the first pair of side walls and the second pair of side walls;

a plurality of lower end flaps secured to the first pair of side walls and the second pair of side walls and a second flexible bag within the outer shell defining a second aperture and a second mouth secured to the second bag surrounding the second aperture and defining a second fluid passageway.

16. The container of claim 15, further comprising a divider between the first and second bags within said outer shell.

17. The container of claim 16, wherein the divider extends between the first pair of sidewalls.

18. A liquid container comprising:

an outer shell defining a first opening and a second opening;

a first flexible bag attached to and housed within the outer shell, the first bag including a tubular member extending through the first opening;

a second flexible bag attached to and housed within the outer shell, the second bag including a second tubular member extending through the second opening; and a stiff divider within the outer shell, the divider separating the first bag from the second bag, wherein the outer shell comprises a bottom, a plurality of side walls extending perpendicularly from the bottom, and a top sloped relative to the bottom.

19. The container of claim 18, wherein at least one of said first bag and said second bag includes a flavor concentrate.

20. The container of claim 18, wherein the first opening is located in the front wall proximate the top and the second opening is located in the back wall proximate the top.

21. The container of claim 20, wherein the divider extends from the front wall to the back wall.

22. A liquid container comprising:

an outer shell defining a first opening and a second opening;

a first flexible bag attached to and housed within the outer shell, the first bag, including a tubular member extending through the second opening; and a stiff divider within the outer shell, the divider separating the first bag from the second bag, wherein the first and second openings are located in opposing side walls of the outer shell and the divider extends between the opposing side walls.

23. The container of claim 22, wherein the first flexible bag houses a hot fluid above the divider and the second flexible bag houses a cold fluid below the divider.

24. The container of claim 23, wherein the divider slopes from below the first opening to above the second opening.

25. A collapsible container for storing and dispensing two separate materials, comprising a front wall and an opposing back wall, the front wall defining a first opening and the back wall defining a second opening;

a pair of opposing side walls extending between the front wall and the back wall;

a plurality of top flaps extending from the front, back and side walls, the top flaps folding to form a container top;

and a plurality of bottom flaps extending from the front, back and side walls, the bottom flaps folding to form a container bottom;

a divider extending from the front wall below the first opening to the back wall above the second opening, the divider defining a first compartment and a second compartment within the front, back and side walls, a first flexible bag defining a first aperture, the first bag housed within the first compartment, and a first mouth secured to the first flexible bag surrounding the first aperture, the first mouth further secured within the first opening; and a second flexible bag defining a second aperture, the second bag housed within the second compartment, and a second mouth secured to the second flexible bag surrounding the second aperture, the second mouth further secured within the second opening.

26. The container of claim 25, further comprising a flavor concentrate in at least one of said first bag and said second bag.

27. A collapsible container for storing and dispensing two separate materials, comprising a front wall and an opposing back wall, the front wall defining a first opening and the back wall defining a second opening;

a pair of opposing walls extending between the front wall and the back wall;

a plurality of top flaps extending from the front, back and side walls, the top flaps folding to form a container top; and a plurality of bottom flaps, extending from the front, back and side walls, the bottom flaps folding to form a container bottom;

a divider extending from the front wall below the first opening to the back wall above the second opening, the divider defining a first compartment and a second compartment within the front, back and side walls, wherein the front wall is taller than the back wall and the container top is angled relative to the container bottom.

28. A collapsible container for storing, and dispensing two separate materials, comprising a front wall and an opposing back wall, the front will defining a first opening and the back wall defining a second opening;

a pair of opposing walls extending between the front wall and the back wall;

a plurality of top flaps extending from the front, back and side walls, the top flaps folding to form a container top; and a plurality of bottom flaps, extending from the front, back and side walls, the bottom flaps folding to form a container bottom;

a divider extending from the front wall below the first opening to the back wall above the second opening, the divider defining a first compartment and a second compartment within the front, back and side walls, wherein a hot fluid is stored within the first compartment above the divider and cold fluid is stored within the second compartment below the divider.

* * * * *